US005785546A

United States Patent [19]

Hamai et al.

[11] Patent Number: 5,785,546

[45] Date of Patent: Jul. 28, 1998

[54] CONNECTOR LOCKING STRUCTURE

[75] Inventors: Tsuyoshi Hamai; Takashi Ishii; Toshiharu Kudo, all of Shizuoka, Japan

[73] Assignee: Yazaki Corporation, Tokyo, Japan

[21] Appl. No.: 758,089

[22] Filed: Nov. 27, 1996

[30] Foreign Application Priority Data

Nov. 27, 1995 [JP] Japan ..... 7-307366

[51] Int. Cl.[6] ..... H01R 13/62

[52] U.S. Cl. ..... 439/354; 439/489

[58] Field of Search ..... 439/354, 489, 439/350–3, 488

[56] References Cited

U.S. PATENT DOCUMENTS

| | | | |
|---|---|---|---|
| 4,915,648 | 4/1990 | Takase et al. | 439/489 |
| 5,176,533 | 1/1993 | Sakuri et al. | 439/435 |
| 5,183,410 | 2/1993 | Inaba et al. | 439/354 |

FOREIGN PATENT DOCUMENTS

| | | | |
|---|---|---|---|
| 5-43484 | 6/1993 | Japan | H01R 13/639 |
| 5-81967 | 11/1993 | Japan | H01R 13/639 |

OTHER PUBLICATIONS

Patents Act 1977 Search Report Under Section 17.

*Primary Examiner*—Khiem Nguyen
*Assistant Examiner*—Eugene G. Byrd
*Attorney, Agent, or Firm*—Sughrue, Mion, Zinn, Macpeak & Seas, PLLC

[57] ABSTRACT

In a connector locking structure, a locking protrusion 1*b* is formed on the upper surface of a flexible locking arm 1 of a male connector, and insufficient engagement preventing protrusions 1*c* are extended from both sides of the locking protrusion, the housing 2 of a female connector has a cut 8, into which the flexible locking arm is inserted, displacement preventing stoppers 8*a* are provided which are confronted with the cut 8 to support the insufficient engagement preventing protrusion, and in the housing 2, a locking confirming slider 3 having an engaging portion 3*b* which is to be engaged with the locking protrusion 1*b* is provided in such a manner that the locking confirming slider 3 is movable back and forth, being kept urged forwardly by springs 4.

6 Claims, 4 Drawing Sheets

CONNECTOR LOCKING STRUCTURE

BACKGROUND OF THE INVENTION

1. Field of the Invention

This invention relates to the locking of a connector which is used for connection of wires in an automobile or the like.

2. Related art

In FIG. 7, reference character a designates a female connector, and b, a male connector; c, a cantilevered flexible locking piece formed by cutting a front casing a' of the female connector. A locking protrusion d is extended inwardly from the front free end of the flexible locking piece c.

A locking confirming movable cover e is mounted on the male connector b in such a manner that it is freely movable back and forth and is kept urged forwardly by springs f built therein.

In the engagement of the female connector a and the male connector b, the flexible locking piece c functions as follows: That is, the taper guide $d_1$ (cf. FIG. 8) of the locking protrusion d of the movable locking piece c is abutted against the upper front end $b_1$ of the male connector b to be placed over the latter b, while it is abutted against the locking confirming movable cover e, thus retracting the latter e against the elastic forces of the springs f.

When the female and male connectors a and b are completely engaged with each other, metal terminals q and h are brought into contact with one another. Under this condition, the locking protrusion d is engaged with a locking hole i formed in the male connector housing, as a result of which the movable locking piece c is restored, thus disengaging from the locking confirming cover e. Hence, the locking confirming movable cover d is moved forwardly by the springs f, to confirm whether or not a complete locking state is obtained, and at the same time it is placed over the movable locking piece c to inhibit the displacement of the movable locking piece c, thus maintaining the male and female connectors engaged with each other.

With the above-described connector locking structure, the locking confirming movable cover e is liable to move. Hence, the structure suffers from the difficulty that the locking protrusion d of the flexible locking piece c is disengaged from the locking hole i, so that the male and female connectors may be disengaged from each other even by a relatively small force.

In view of the foregoing, an object of the invention is to provide a connector locking structure with which a pair of connectors are prevented from being insufficiently engaged with each other, and are positively maintained engaged with each other.

SUMMARY OF THE INVENTION

The foregoing object of the invention has been achieved by the provision of a connector locking structure in which, according to the invention,

- a locking protrusion is formed on the upper surface of a flexible locking arm of a male connector, and insufficient engagement preventing protrusions are extended from both sides of the locking protrusion,
- a female connector has displacement preventing stoppers which support the insufficient engagement preventing protrusions,
- a locking confirming slider is provided in such a manner as to be movable back and forth,

- the locking confirming slider being urged forwardly by springs,
- during engagement of the male connector and the female connector with each other, the locking protrusion is engaged with the locking confirming slider to move the locking confirming slider backwardly,
- when the male connector and the female connector have been completely engaged, the insufficient engagement preventing protrusions are disengaged from the displacement preventing stoppers,
- whereby the elastic forces of the springs displace the flexible locking arm through the locking confirming slider, while the locking confirming slider is moved forwardly being disengaged from the locking protrusion, and
- in response to the movement of the locking confirming slider, the flexible locking arm is restored, and the locking protrusion is engaged with a locking portion of the locking confirming slider.

Hence, with the aid of the insufficient engagement preventing protrusions and the displacement preventing stoppers therefor, the incomplete engagement of the male and female connectors with each other is positively prevented. In the case where the male and female connectors are incompletely engaged with each other, the flexible locking arm is engaged with the locking confirming slider, and therefore the difficulty is eliminated that the locking confirming slider moves unintentionally to break the engagement.

DETAILED DESCRIPTION OF THE PREFERRED EMBODIMENTS

Figure 1:
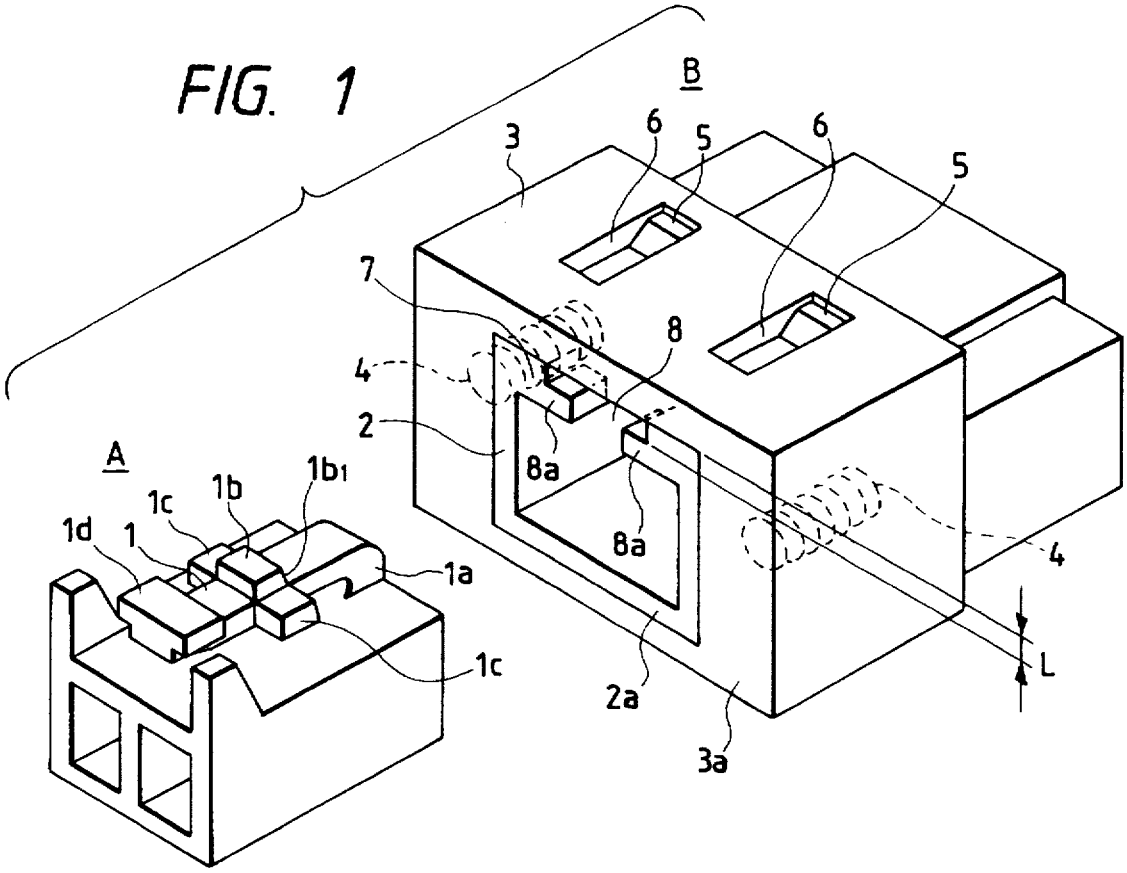
FIG. 1 is a perspective view of a male connector and a female connector disengaged from the former, for a description of the connector locking structure, which constitutes a preferred embodiment.

In FIG. 1, reference character A designates a male connector; and B, a female connector. Those connectors A and B are made of synthetic resin, and have metal terminals which are connected to one another when the connectors A and B are completely engaged with each other.

The male connector has a flexible locking arm 1 on its upper surface. The flexible locking arm 1 is extended backwardly, having a rise base portion 1*a* at the front end.

Furthermore, the flexible locking arm 1 has a locking protrusion 1*b* at the middle. The locking protrusion 1*b* has a taper guide surface $1b_1$ at the front end, and a pair of insufficient engagement preventing protrusions 1*c* and 1*c* on both sides. The free end portion of the flexible locking arm 1 is employed as an operating portion 1*d*.

The front end portion of the female connector B is formed into a housing 2, with which the male connector A is engaged. A locking confirming slider 3 is mounted on the housing 2 in such a manner that it is slidable back and forth and is kept urged forwardly by springs 4 built therein. The housing 2 has flexible stoppers 5 on its upper wall in such a manner that, when the flexible stoppers are engaged with engaging elongated holes 6 formed in the locking confirming slider 3, the front end face 3*a* of the locking confirming slider is flush with the front end face 2*a* of the housing 2. That is, the flexible stoppers 5 determines the forward position of the housing 3 which is being urged by the springs.

Figure 2:
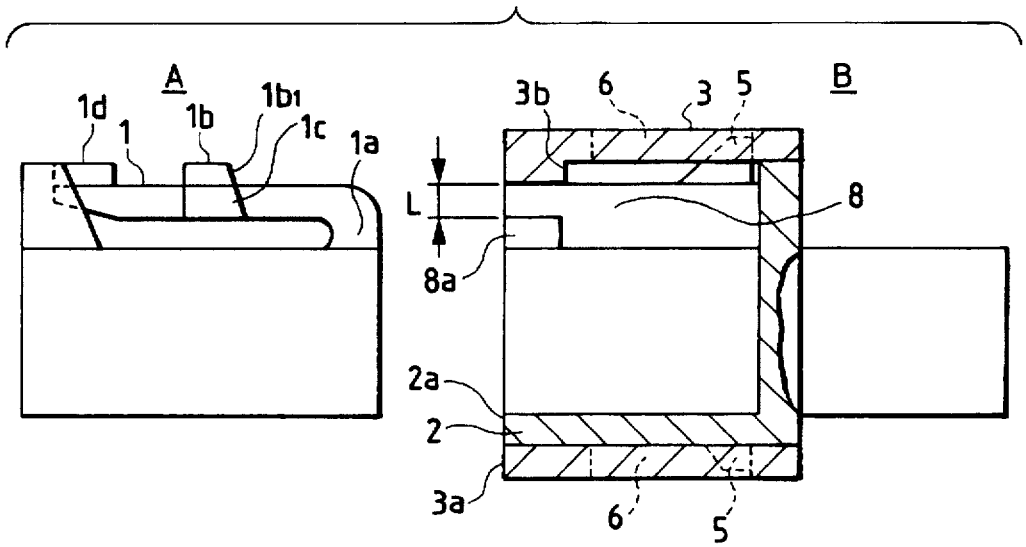
FIG. 2 is a side view, with parts cut away, showing a state of the connector locking structure before the male and female connectors are engaged with each other.

In the female connector B, the upper wall of the housing 2 has a cut 8 at the middle. More specifically, the cut 8 is extended in the front-to-rear direction of the housing 2 so that the flexible locking arm 1 is inserted into the cut 8. At the front end of the cut 8, the portions of the upper wall of the housing 2 which define the cut 8 are formed into a pair of displacement preventing stoppers 8*a* and 8*a* which prevents the displacement of the flexible locking arm, with a clearance L provided between the locking confirming slider 3 and the displacement preventing stoppers 8*a* to permit the entrance of the aforementioned insufficient engagement preventing protrusions 1*c* of the flexible locking arm 1. The portion of the inner surface of the locking confirming slider 3 which corresponds to the space between the displacement preventing stoppers 8*a* and 8*a* and confront with the inner end faces of the latter 8*a* and 8*a* is formed into an engaging portion 3*b* which is engaged with the locking protrusions 1*d* and 1*b* (as shown in FIG. 2).

Figure 3:
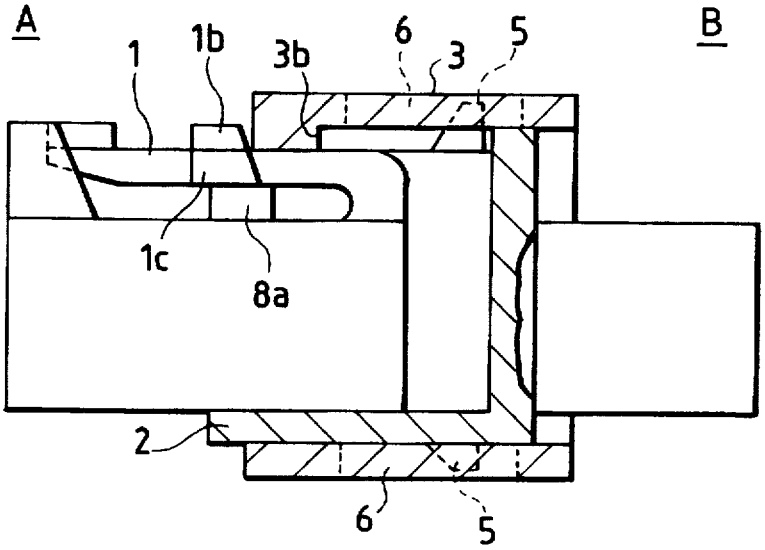
FIG. 3 is a side view, with parts cut away, showing a state of the connector locking structure at the start of engagement of the male and female connectors.
Figure 4:
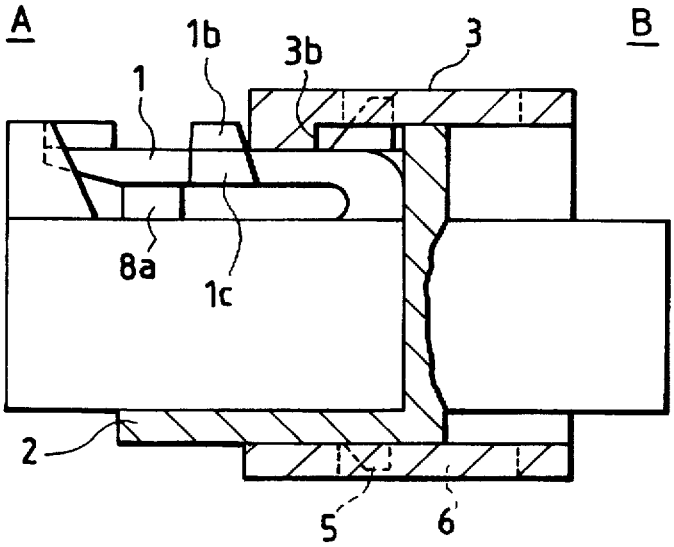
FIGS. 4 and 5 are side views, with parts cut away, showing states of the connector locking structure during the engagement of the male and female connectors.

When the engagement of the male and female connectors A and B is started, the flexible locking arm 1 is moved into the cut 8 of the housing 2, while the insufficient engagement preventing protrusions 1*c* are moved over the displacement preventing stoppers 8*a*, and engaged with the front wall (front end face) 3*a* of the end face 8*a*, thus moving the locking confirming slider 3 backwardly (cf. FIGS. 3 and 4). In the case where the engagement is carried out with the flexible locking arm 1 displaced, the insufficient engagement preventing protrusions 1*c* collide with the displacement preventing stopper 8*a*, thus preventing the engagement. On the other hand, during the engagement, the displacement of the flexible locking arm 1 is prevented by the displacement preventing stopper 8. Hence, during the engagement, the incomplete connection is prevented.

Figure 5:
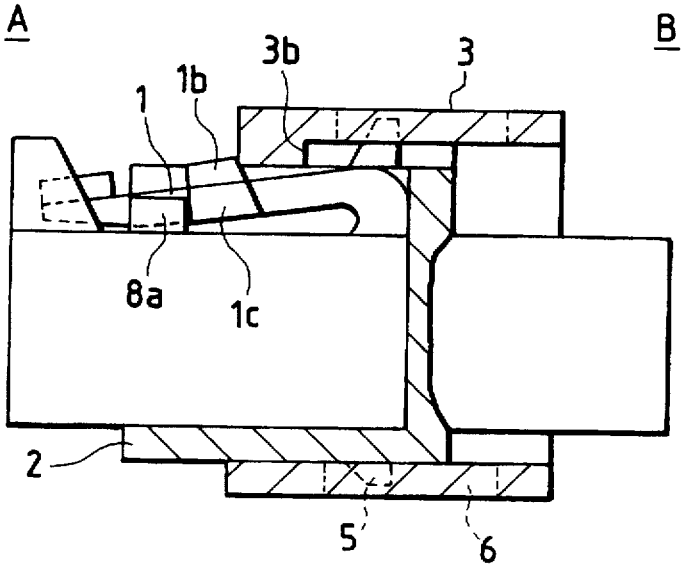
Figure 6:
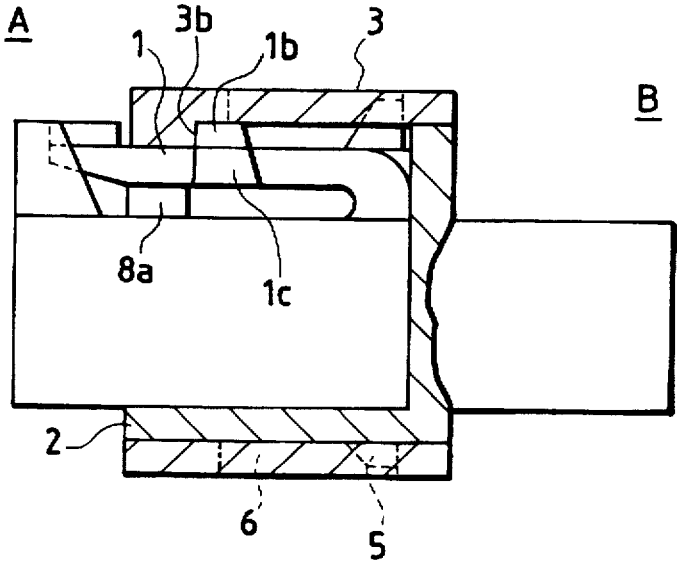
FIG. 6 is a side view, with parts cut away, showing a state of the connector locking structure after the male and female connectors have been completely engaged with each other.
Figure 7:
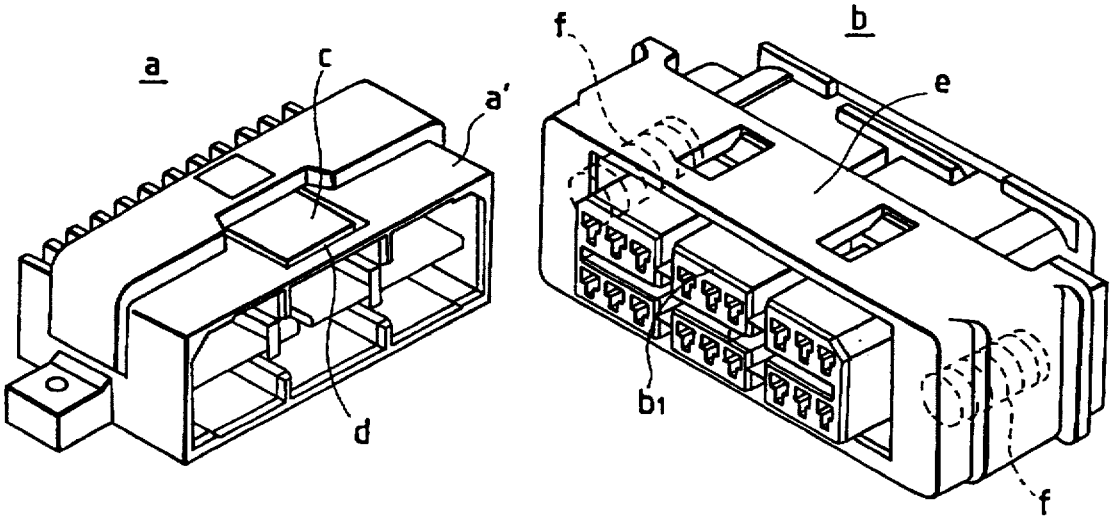
FIG. 7 PRIOR ART
FIG. 7 is a perspective view of male and female connectors, for a description of a conventional connector locking structure.
Figure 8:
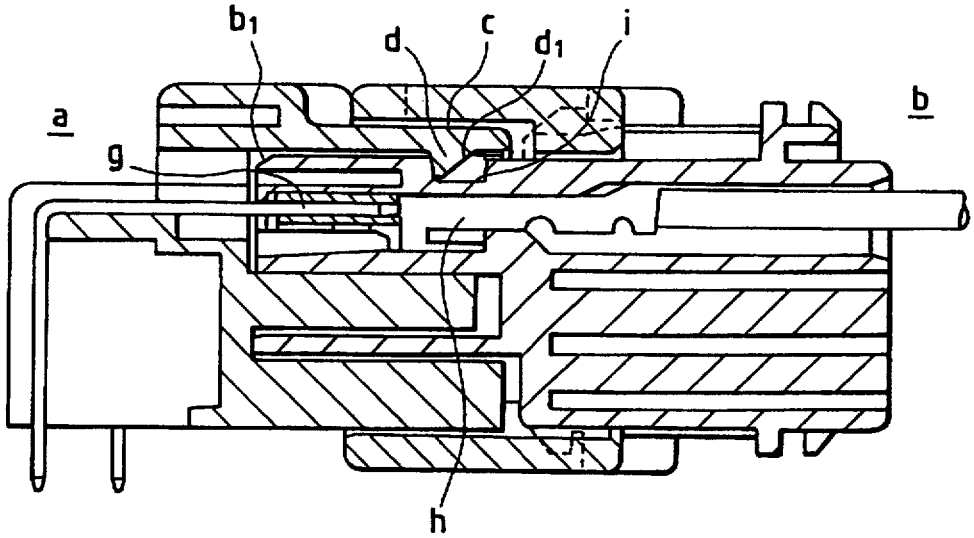
FIG. 8 PRIOR ART
FIG. 8 is a sectional view of the male and female connectors which have been completely engaged with each other, for a description of the conventional connector locking structure.

When the male and female connectors A and B have been engaged with each other, the insufficient engagement preventing protrusions 1*c* of the flexible locking arm 1 are disengaged from the displacement preventing stoppers 8*a*, so that the flexible locking arm 1 becomes displaceable. Hence, the elastic force of the springs 4 moves the locking confirming slider 3 forwardly while displacing the flexible locking arm 1 downwardly with the aid of the locking confirming slider 3 and the taper guide surface $1b_1$ (cf. FIG. 5). As a result, at the foremost position of the locking confirming slider 3, the locking protrusion 1*b* confronts with the engaging portion 3*b*, whereby the flexible locking arm 1 is restored, and the locking protrusion 1*b* is engaged with the locking portion 3*b* (cf. FIG. 6).

As was described above, in the connector locking structure of the invention, the locking protrusion is formed on the upper surface of the flexible locking arm of the male connector, and insufficient engagement preventing protrusions are extended from both sides of the locking protrusion, the female connector has the displacement preventing stoppers which support the insufficient engagement preventing protrusions, the locking confirming slider is provided in such a manner as to be movable back and forth,the locking confirming slider being urged forwardly by springs, during engagement of the male connector and the female connector with each other, the locking protrusion is engaged with the locking confirming slider to move the locking confirming slider backwardly, when the male connector and the female connector have been completely engaged, the insufficient engagement preventing protrusions are disengaged from the displacement preventing stoppers, whereby the elastic forces of the springs displace the flexible locking arm through the locking confirming slider, while the locking confirming slider is moved forwardly being disengaged from the locking protrusion, and with the movement of the locking confirming slider, the flexible locking arm is restored, and the locking protrusion is engaged with the locking portion of the locking confirming slider.

Hence, with the aid of the insufficient engagement preventing protrusions and the displacement preventing stoppers therefor, the incomplete engagement of the male and female connectors with each other is positively prevented. In the case where the male and female connectors are incompletely engaged with each other, the flexible locking arm is engaged with the locking confirming slider, and therefore the difficulty is eliminated that the locking confirming slider moves unintentionally to break the engagement.

What is claimed is:

1. A connector locking structure comprising:

a male connector having a locking protrusion formed on the upper surface of a flexible locking arm of said male connector, and insufficient engagement preventing protrusions extended from at least one side of said locking protrusion;

a female connector having displacement preventing stoppers which support said insufficient engagement preventing protrusions; and a locking confirming slider provided in such a manner that said locking confirming slider is movable back and forth, being kept urged forwardly by springs, wherein during engagement of said male connector and said female connector with each other, said locking protrusion is contacted with said locking confirming slider to move said locking confirming slider backwardly, when said male connector and said female connector have been completely engaged, said insufficient engagement preventing protrusions are disengaged from said displacement preventing stoppers, whereby the elastic forces of said springs displace said flexible locking arm through said locking confirming slider, while said locking confirming slider is moved forwardly being disengaged from said locking protrusion, and in response to the movement of said locking confirming slider, said flexible locking arm is restored, and said locking protrusion is engaged with a locking portion of said locking confirming slider.

2. A connector locking structure as claimed in claim 1, wherein said displacement preventing stoppers are formed with a clearance provided between said locking confirming slider and said displacement preventing stoppers to permit the entrance of said insufficient engagement preventing protrusions thereinto.

3. A connector locking structure as claimed in claim 1, wherein said locking protrusion has a taper guide surface at the front end.

4. A connector locking structure as claimed in claim 2, wherein said locking protrusion has a taper guide surface at the front end.

5. The connecting locking structure of claim 1, wherein said locking confirming slider is formed outside a housing of said female connector, wherein said displacement preventing stoppers are integral with said housing.

6. The connecting locking structure of claim 5, wherein said locking confirming slider has at least one engaging elongated hole formed therein for engaging with at least one flexible stopper formed in a wall of said housing, so that said at least one flexible stopper member prevents said locking confirming slider from sliding off said housing.

* * * * *